US005219300A

United States Patent [19]

Yagi et al.

[11] Patent Number: 5,219,300

[45] Date of Patent: Jun. 15, 1993

[54] CONNECTOR WITH A TERMINAL LOCKING MEMBER

[75] Inventors: Sakai Yagi; Masanori Tsuji; Motohisa Kashiyama, all of Shizuoka, Japan

[73] Assignee: Yazaki Corporation, Tokyo, Japan

[21] Appl. No.: 857,003

[22] Filed: Mar. 25, 1992

[30] Foreign Application Priority Data

Mar. 26, 1991 [JP] Japan ..... 3-018475[U]

[51] Int. Cl.[5] ..... H01R 13/627

[52] U.S. Cl. ..... 439/532; 439/354

[58] Field of Search ..... 439/752, 350–355, 439/357; 292/257

[56] References Cited

U.S. PATENT DOCUMENTS 3,097,033 7/1963 Felts ..... 439/352
3,639,950 2/1972 Lutz et al. ..... 439/350 X
4,655,527 4/1987 Van Dame ..... 439/350
4,708,662 11/1987 Klein ..... 439/353
4,950,179 8/1990 Takenouchi et al. ..... 439/352
4,993,967 2/1991 Matsumoto ..... 439/352 X

*Primary Examiner*—David L. Pirlot
*Attorney, Agent, or Firm*—Armstrong, Westerman, Hattori, McLeland & Naughton

[57] ABSTRACT

The connector consists of a male connector housing with a resilient locking arm, a terminal locking member mounted to the rear of the male connector housing in two steps, i.e., a preliminarily engaged state and a fully engaged state, and a stopper provided to the terminal locking member. In the fully engaged state, the stopper is located below a control portion of the resilient locking arm. When the male connector housing is unlocked from a female connector housing, the stopper comes into contact with the resilient locking arm to prevent an excessive displacement of the locking arm and keep the locking arm free from damage.

1 Claim, 6 Drawing Sheets

CONNECTOR WITH A TERMINAL LOCKING MEMBER

BACKGROUND OF THE INVENTION

1. Field of the Invention

The present invention relates to a connector mainly for use in connecting automotive wire harnesses, and more particularly to a connector with a terminal locking member mounted at the rear portion thereof.

2. Description of the Prior Art

An example of conventional connector is shown in FIGS. 9 and 10.

In FIG. 9, reference symbol a represents a male connector housing and b a female connector housing. The male connector housing a is provided with a double-handled resilient locking arm c having a locking projection c1 formed thereon. The female connector housing b is proveded with an engagement frame portion d that defines a locking slot d1.

FIG. 10 shows the female and male connector housings a and b in an engaged and locked state. From this state, a press is given to a control portion c2 to displace the resilient locking arm c downwardly as indicated by the imaginary line, thereby disengaging the locking projection c1 from the locking slot d1 and attaining unlocking.

In the above construction, the force with which the resilient locking arm c is pressed to unlock the connector housings from each other tends to become unnecessarily large, resulting in excessive displacement of the locking arm and frequent damages thereto.

SUMMARY OF THE INVENTION

This invention has focused attention on the above problem and provides a construction wherein the excessive displacement of the resilient locking arm in unlocking is prevented, resulting in no damages to the locking arm.

To achieve the above objective, a connector with a terminal locking member of this invention comprises: a connector housing having a resilient locking arm; a terminal locking member movably mounted to the connector housing in two steps, said two steps including a preliminarily engaged state and a fully engaged state; and a stopper provided to the terminal locking member, said stopper coming into a locus of resilient displacement of the resilient locking arm of the connector housing in the fully engaged state to prevent an excessive displacement of the resilient locking arm.

When a force is applied to displace the locking arm in unlocking, the locking arm comes into contact with the stopper at a fixed position.

DETAILED DESCRIPTION OF PREFERRED EMBODIMENT

In FIGS. 1 to 4, reference symbol A represents a connector housing and B a terminal locking member, each integrally formed of synthetic resin.

In the connector housing A, there are four laterally arranged, longitudinally extended hollow terminal accommodating chambers 1 at the upper tier with an intermediate space 2 interposed at the middle. At the lower tier there is a row of six laterally arranged terminal accommodating chambers 1. At the intermediate space 2 on the upper tier there is formed a double-handled resilient locking arm 3 including at its front, rear and intermediate portions a support portion 3*a*, a base rising portion 3*b*, and a locking projection 3*c* and a control portion 3*d*, respectively.

Figure 6:
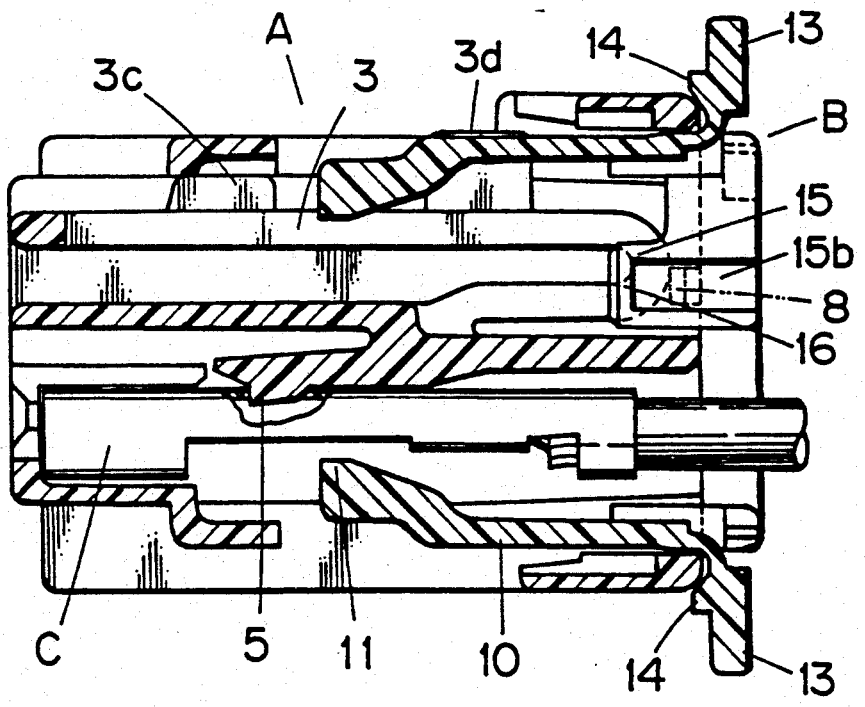
FIG. 6 is a cross section taken along the line A—A of FIG. 5 but showing the connector housing and the terminal locking member in a preliminarily engaged state.

The terminal accommodating chambers at the upper tier each has at its rear portion an opening 1*a* laterally defined by neighboring separation walls and directed upwardly as seen in the figures, while the terminal accommodating chambers at the lower tier each has at its rear portion an opening 1*a* directed downwardly. Each terminal accommodating chamber 1 has a resilient engagement piece 5 that works as a first locking member for a terminal lug C (FIG. 6).

Around the outer circumference of the rear end of the connector housing A is provided, via a connecting portion 6*a* on either side of the housing A, with a hood 6 with a continuous gap g interposed therebetween. The hood 6 has full engagement recesses 7 formed on its inner surfaces. Both of the separation walls 4, 4 that laterally define the intermediate space 2 are formed at their rear ends with preliminary engagement projections 8 that face the intermediate space 2.

The terminal locking member B includes a main frame portion 9 and is provided with a plurality of laterally arranged resilient support poeces 10 that extend forwardly from the upper and lower portions of the frame portion 9. The free end of each resilient support piece 10 is formed with a terminal locking projection 11 that projects into the corresponding terminal accommodating chamber 1 through the opening 1*a* so as to work as a second locking member for the terminal lug C.

The upper and lower portions of the main frame portion 9 are provided at their rear ends with engagement plates 13 that are normally urged to assume an upright attitude by resilient hinges 12. The engagement plate 13 is formed on its outer surface with projections 14 that engage with the full engagement recesses 7 of the hood 6 to ensure full-engagement between the connector housing A and the terminal locking member B.

A pair of laterally arranged stopper plates 15 are provided, via suspended portions 15*a*, to the underside of the upper portion of the main frame portion 9 and extend forwardly. The stopper plate 15 is formed, on its surface on the side of the preliminary engagement projection 8, with a longitudinally extending groove 15*b* for accommodating the preliminary engagement projection 8 therein and with a preliminary engagement step portion 16.

Figure 1:
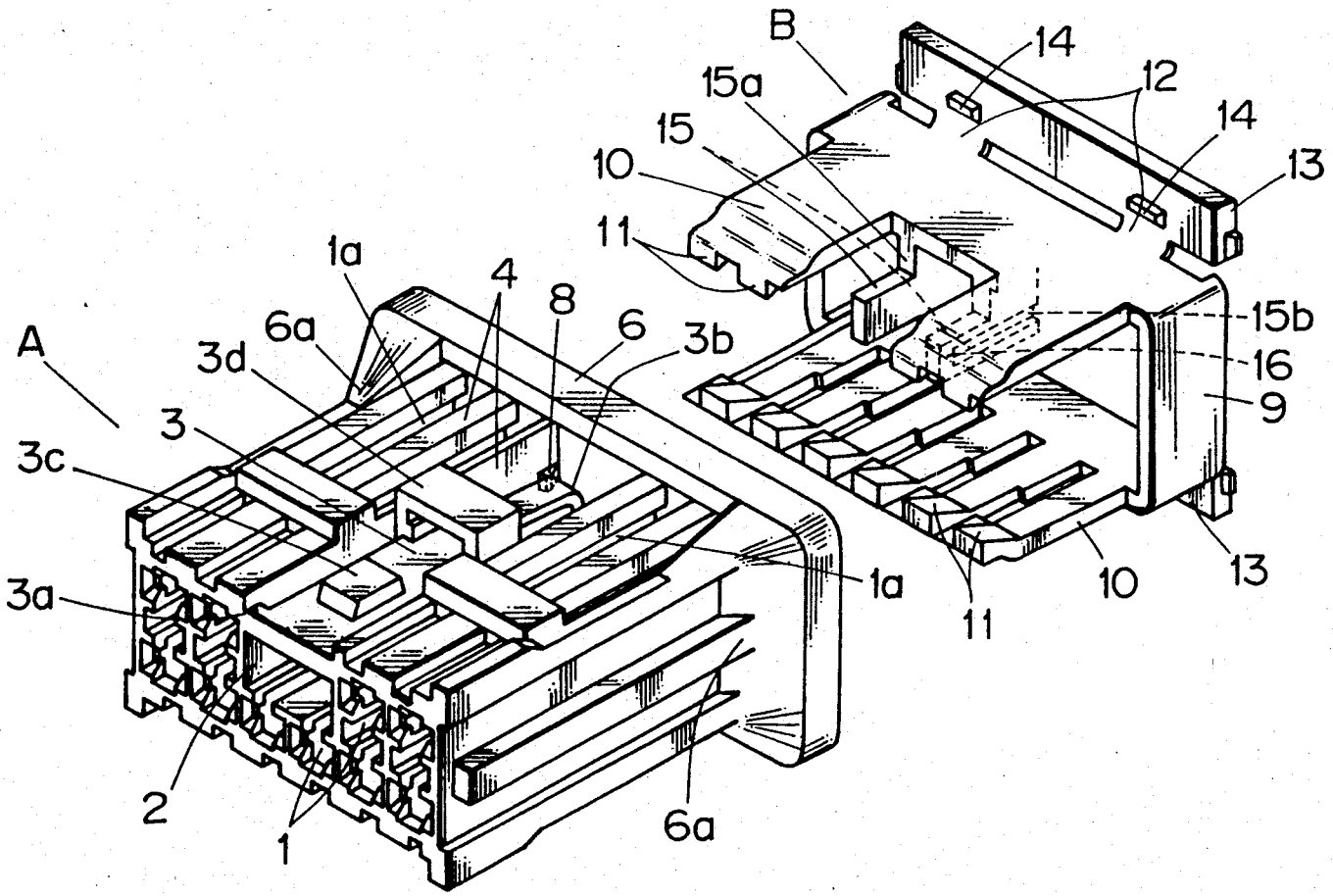
FIG. 1 is a perspective view, seen from the front, of a connector housing and a terminal locking member as one embodiment of the invention shown separated from each other.
Figure 2:
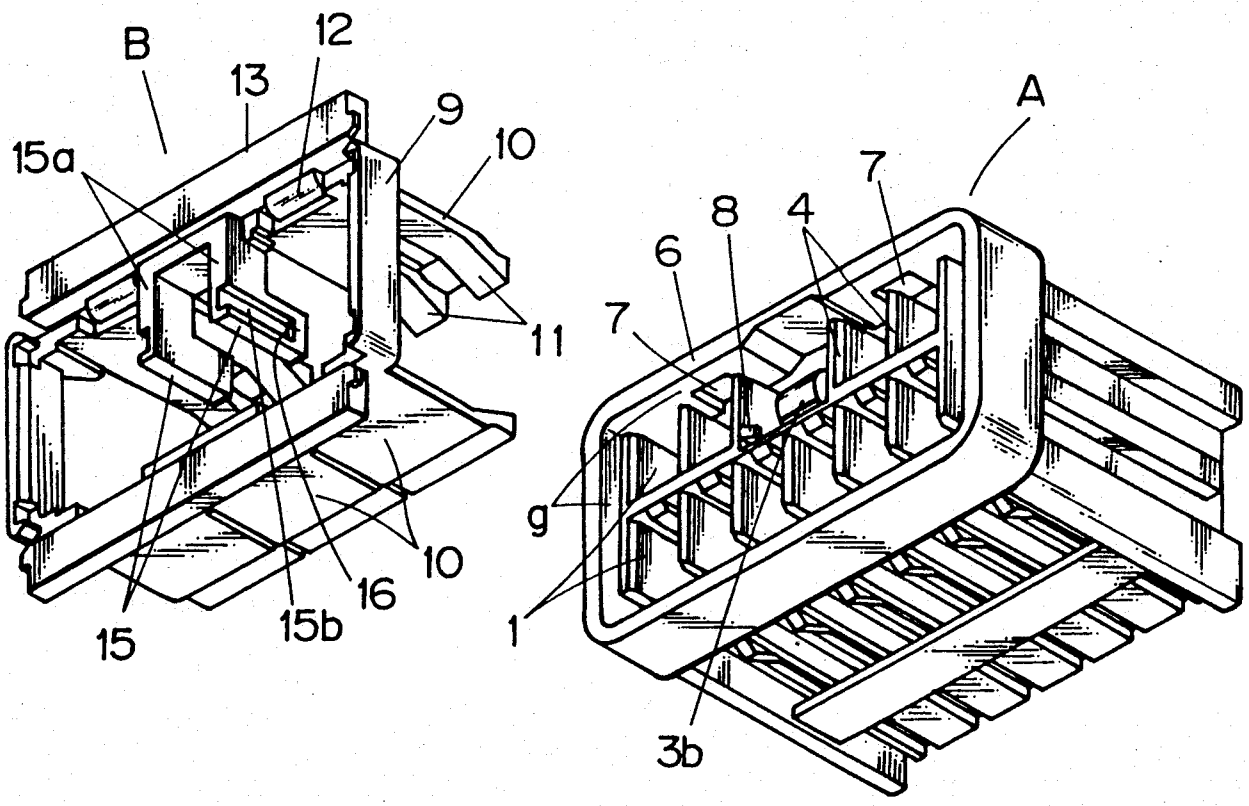
FIG. 2 is a perspective view of the connector housing and the terminal locking member seen from the rear.
Figure 3:
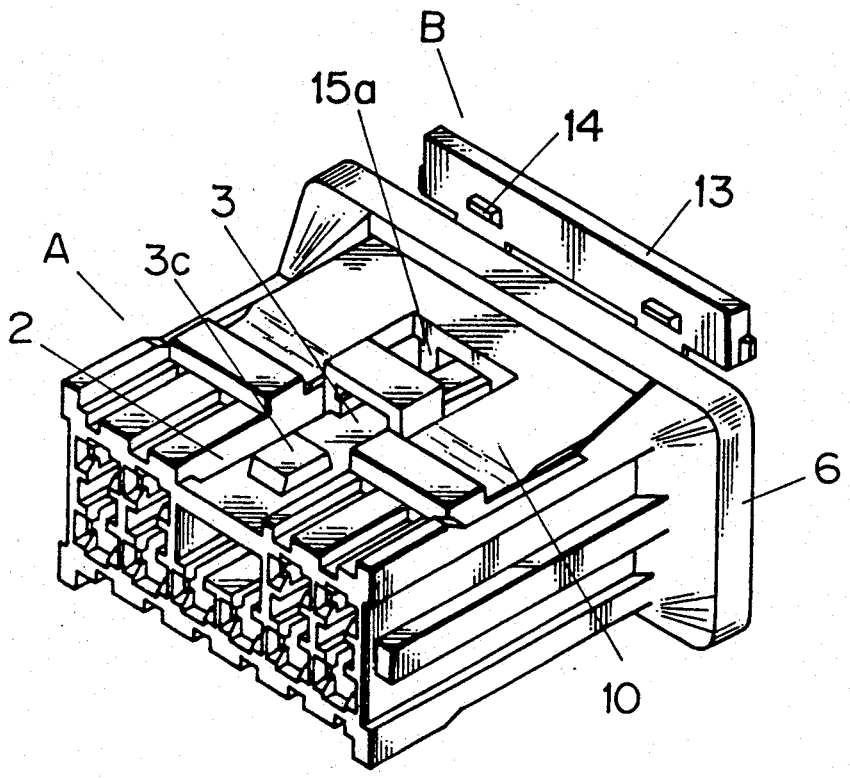
FIG. 3 is a perspective view of the connector housing and the terminal locking member in a preliminarily engaged state.

In the above construction, the terminal locking member B is coupled to the connector housing A first in the preliminarily engaged state (FIGS. 3 and 6). The preliminarily engaged state is obtained by the following procedure. The terminal locking projections 11 of the resilient support pieces 10 are inserted through the openings 1*a* into the terminal accommodating chambers 1 and the main frame portion 9 of the terminal locking member B is inserted into the gap g, while at the same time accommodating the preliminary engagement projections 8 in the grooves 15*b* in the stopper plates 15 so as to have the projections 8 to abut against the step portions 16. Thus, the terminal locking member B is prevented from being accidentally pulled out of the connector housing A. In this preliminarily engaged state, terminal lugs C are inserted into the associated terminal accommodating chambers 2 and are firstly locked by the resilient engagement pieces 5 from coming off rearwardly. In the preliminarily engaged state, the upright engagement plate 13 abuts against the rear end of the hood 6 of the connector housing A to prevent the terminal locking member B from undesirably moving further into the connector housing A.

Figure 4:
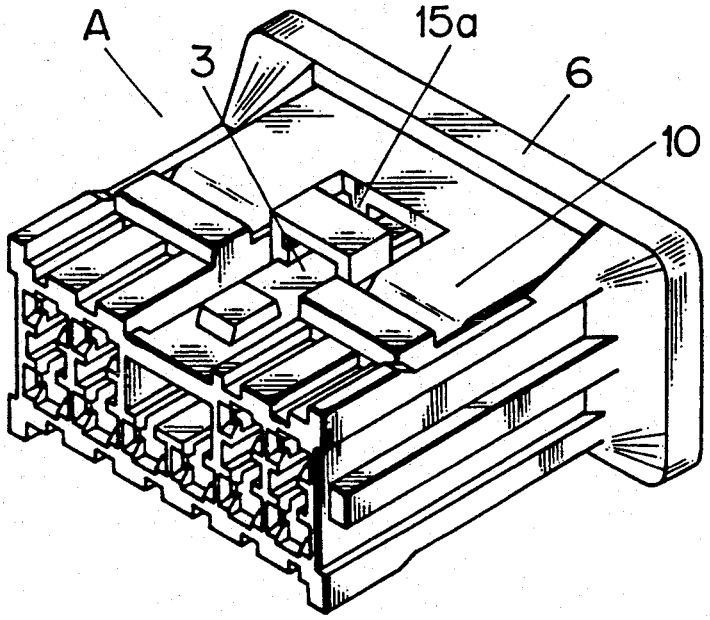
FIG. 4 is a perspective view of the connector housing and the terminal locking member in a fully engaged state.

When the insertion of the terminal lugs C has been completed, the engagement plate 13 is set horizontal and the terminal locking member B is pushed into the connector housing A until the full engagement projection 14 engages with the full engagement recess 7 so that the terminal locking member B and the connector housing A are held in the fully engaged state (FIG. 4).

Figure 5:
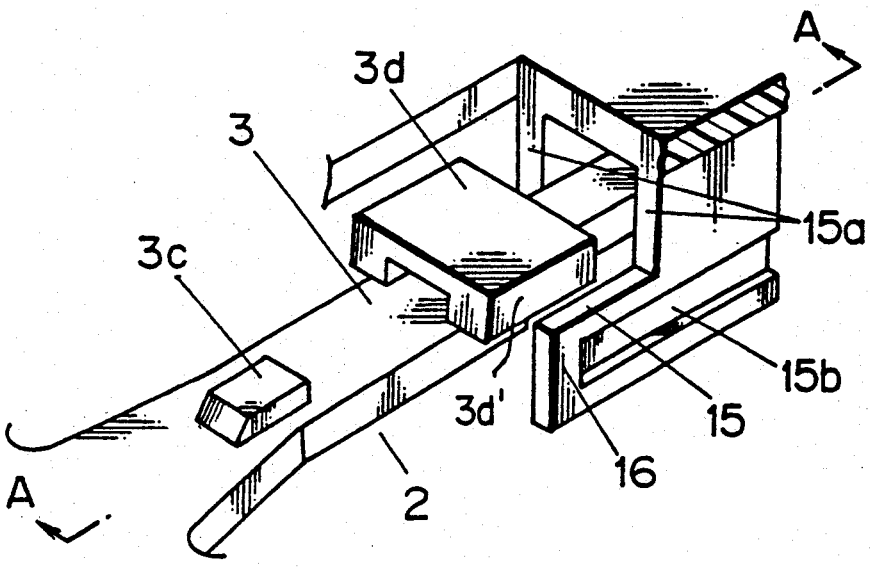
FIG. 5 is a perspective view showing essential portions of FIG. 4.
Figure 7:
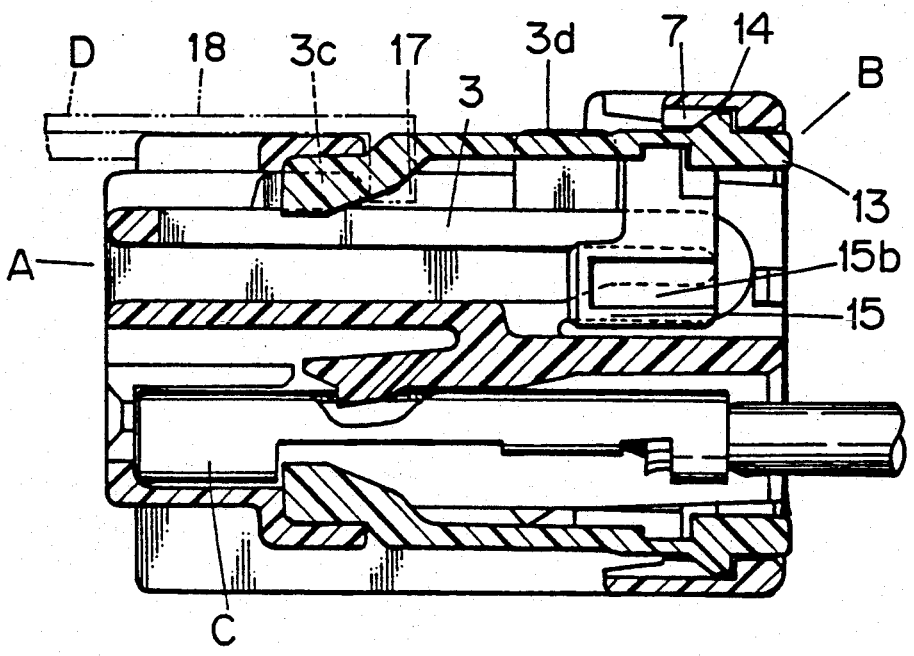
FIG. 7 is a cross section, similar to FIG. 6, showing the connector housing and the terminal locking member in a fully engaged state.

In the fully engaged state, the terminal locking projection 11 of the resilient support piece 10 engages with the terminal lug C to secondly lock the same from coming off rearwardly, while at the same time the stopper plate 15 comes into a locus of resilient displacement of the resilient locking arm 3, which is located below bulged portions 3*d*' formed on both sides of the control portion 3*d* (FIGS. 5 and 7).

In FIG. 7, reference symbol D represents a female connector housing, which has been engaged with the connector housing A. In this engaged state, the locking projection 3*c* formed on the resilient locking arm 3 engages with an engagement portion 17 formed on the inner side of the male connector housing-receiving portion 18.

Figure 8:
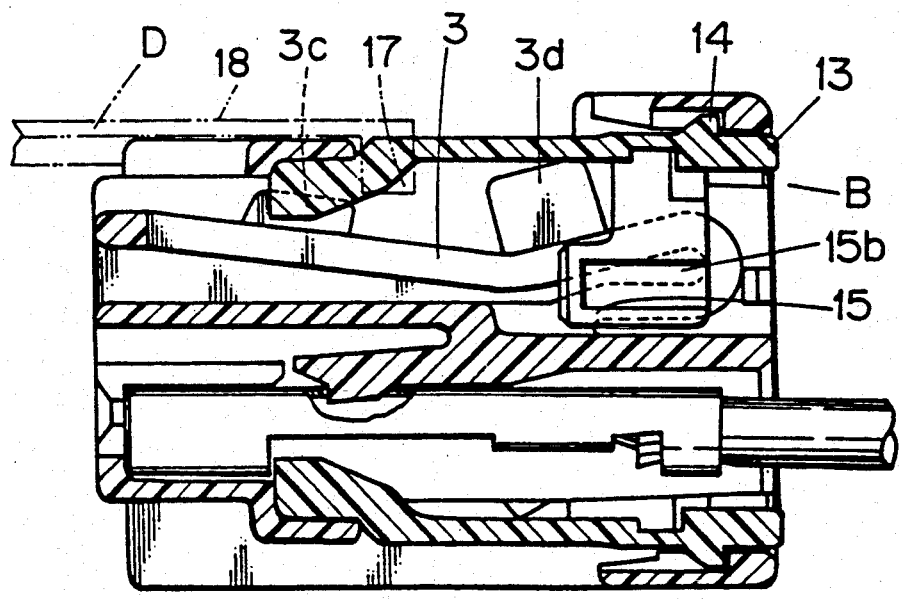
FIG. 8 is a cross section showing the connector housing and the terminal locking member when being unlocked from the position in FIG. 7.
Figure 9:
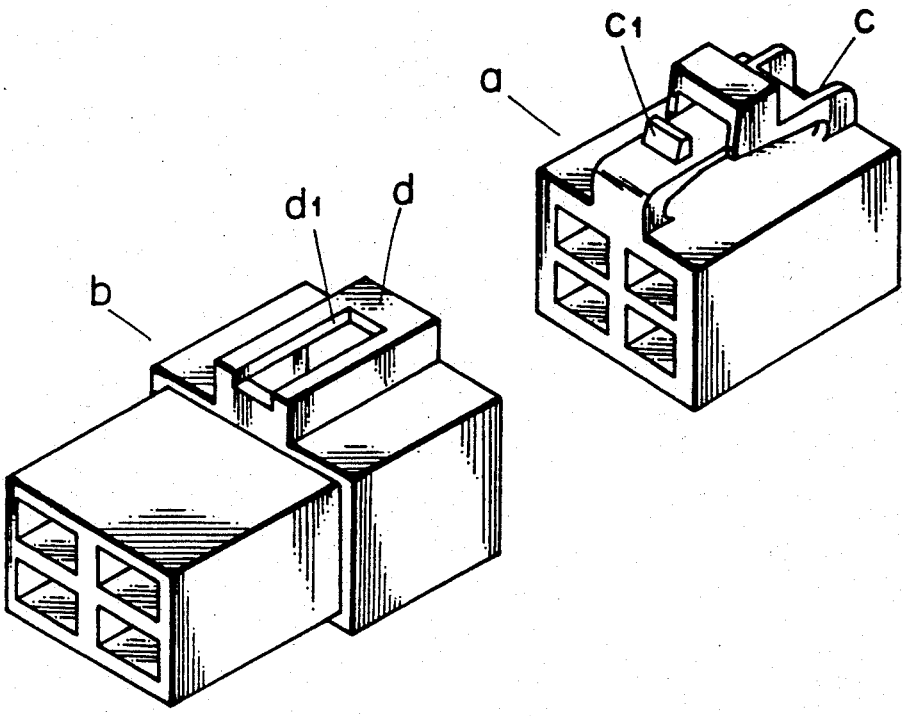
FIG. 9 PRIOR ART
FIG. 9 is a perspective view of conventional female and male connector housings shown separated from each other.
Figure 10:
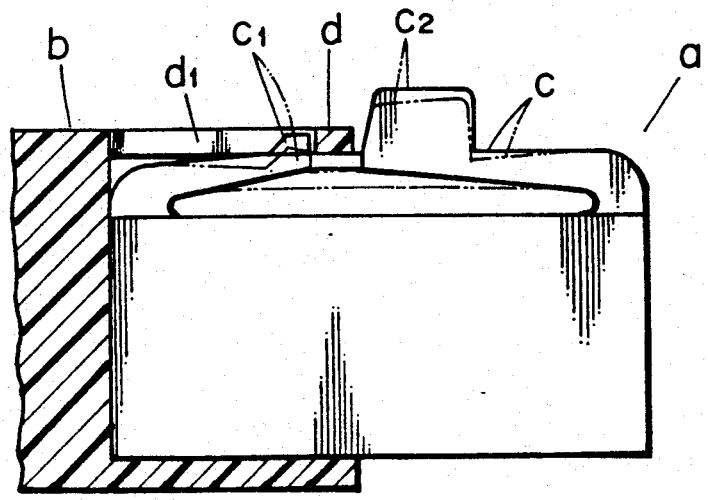
FIG. 10 PRIOR ART
FIG. 10 is a cross section showing the conventional female and male connector housings in an engaged state.

FIG. 8 denotes an unlocked state in which the control portion 3*d* is pressed to resiliently displace the resilient locking arm 3 and to disengage the locking projection 3*c* from the engagement portion 17, at which time the bulged portion 3*d*' of the control portion 3*d* abuts against the stopper plate 15 to prevent an excess amount of displacement of the resilient locking arm 3 (FIG. 8).

As described hereinbefore, a connector with a terminal locking member of this invention comprises a connector housing with a resilient locking arm and a terminal locking member movably mounted to the connector housing in two steps —a preliminarily engaged state and a fully engaged state. In the fully engaged state, a stopper provided to the terminal locking member comes into a locus of resilient displacement of the locking arm and prevents an excessive displacement of the locking arm, thereby preventing damages to the resilient locking member otherwise often caused in unlocking the male and female connector housings from each other.

What is claimed is:

1. A connector with a terminal locking member comprising:

a connector housing having a resilient locking arm biased to an engaged position for engaging a mating connector housing and displaceable to a disengaged position;

a terminal locking member movably mounted to said connector housing in two steps, said two steps including a preliminary engaged state and a fully engaged state; and a stopper provided on said terminal locking member, said stopper moving into a position opposite said resilient locking arm of said connector housing when said terminal locking member is moved to the fully engaged state to prevent excessive movement of said resilient locking arm when it is displaced from said engaged position to said disengaged position.

* * * * *